US005509541A

United States Patent [19]

Merl

[11] Patent Number: 5,509,541

[45] Date of Patent: Apr. 23, 1996

[54] BRACKET CONSTRUCTION

[76] Inventor: Milton J. Merl, 50 Wilcox Rd., Stonington, Conn. 06830

[21] Appl. No.: 259,464

[22] Filed: Jun. 14, 1994

[51] Int. Cl.[6] ..... A47H 1/00; A47H 2/00; A47H 7/00; A47H 13/00

[52] U.S. Cl. ..... 211/103; 211/106; 211/175; 211/208; 211/94; 211/71; 211/193; 248/218.4; 248/242

[58] Field of Search ..... 211/208, 103, 211/71, 94, 106, 189, 190, 193; 248/242, 218.4

[56] References Cited

U.S. PATENT DOCUMENTS

| | | | |
|---|---|---|---|
| 3,093,094 | 6/1963 | Oztekin | 108/6 |
| 3,538,860 | 11/1970 | Fisher | 108/1 |
| 4,583,648 | 4/1986 | Buffington et al. | 211/90 |
| 4,634,010 | 1/1987 | Otema | 211/96 |
| 5,305,898 | 4/1994 | Merl | 211/87 |

FOREIGN PATENT DOCUMENTS

| | | | |
|---|---|---|---|
| 2742986 | 3/1978 | Germany | 211/193 |

*Primary Examiner*—Leslie A. Braun
*Assistant Examiner*—Brian J. Hamilla
*Attorney, Agent, or Firm*—Schweitzer Cornman & Gross

[57] ABSTRACT

An improved bracket construction for the storage and display of cylindrically and dish-shaped products in an orientation in which the top thereof is oriented generally vertically includes a pair of horizontal hanging bar units adapted to mount to the vertical standards utilized in conjunction with conventional gondola displays. The hanging bar units include a hanging bar and attachable brackets, the brackets being positionable along the length of the hanging bar and having hooks for engaging the vertical gondola standards. Vertical uprights are mounted to the hanging bars, and support at least one cradle assembly for support of the products. In a preferred embodiment, the cradle assembly includes a horizontal bar which is mounted to the vertical uprights, and at least one product cradle, extending forwardly therefrom. The products cradle may be formed from a U-shaped wire element and a pair of wire elements extending from the front portion of the U to the horizontal bar to form a triangular bracing structure for the products.

10 Claims, 7 Drawing Sheets

76
86
90
92
106
108
110
112
114
116
140
142
144
146
16
20
22
24
26
28
30
32
34
36
38
40
42
68
70
96
98
100
102
104

BRACKET CONSTRUCTION

The present invention relates to merchandising systems and more particularly to an improved bracket for use in conjunction with currently available merchandising displays.

SUMMARY OF THE INVENTION

The majority of inventory in retail stores are carried in a form of construction utilizing gondolas or trays for the products. Such format has changed little over the years. A floor platform supports a vertical upright backing board which defines the gondola. The gondola includes vertical weight-supporting uprights having a plurality of vertical slots. The slots and uprights are adapted to support shelving and other elements in or on which merchandise is placed for display. While such gondolas are typically employed for the display of goods directly on the selling floor, similar structures are employed in freezer cases and the like for the display and storage of refrigerated goods.

Such gondolas are required to display and support an ever increasing variety of products in a staggering assortment of packaging. Each product must be displayed in a gondola at an assigned location, not intermixed with other products or even the same product in a different size or packaging. The current gondola merchandising system is ill-equipped to handle such variety. There is typically not enough gondola space available to keep and display all the products.

A particular problem exists when the packaging is not of a standard rectangular box format. In particular, products packaged in cylindrical dish, tub or canister-like packaging is difficult to display and maintain in conjunction with standard gondola designs. When the product is stacked in vertical piles the top, which presents the clearest and largest display area for labeling, cannot be seen by the customer. Rather, the customer is presented with a curved sidewide surface presenting an ineffective display. In addition, the product can slide and reposition itself across the shelf, requiring additional labor and time to reorient the product and restock.

Further, shelving which has a fixed height over a significant run is inefficient to stack and display products of differing sizes and shapes.

OBJECTS AND ADVANTAGES OF THE PRESENT INVENTION

It is accordingly an object of the present invention to develop an improved bracket system for supporting generally cylindrical, dish and tub-based inventory.

Yet another object of the present invention is to provide a bracket system in which a greater product density for a cylindrical packaged product for a given amount of volume may be achieved.

Yet a further object of the present invention is to provide a bracket construction which allows the top face, rather than the curved sidewall, of a cylindrical container to be presented to the public for display purposes.

Still another purpose of the present invention is to provide a bracket for cylindrically-packaged products which may be easily utilized in conjunction with conventional gondola constructions and which provides flexibility in layout.

A further purpose of the present invention is to provide such a bracket construction in a manner which is economical to construct and of simplified use.

Yet another purpose of the present invention is to provide a bracket for cylindrical packaging in which product identification can be located at the front edge of the bracket.

Still another purpose of the present invention is to provide a bracket for cylindrically packaged goods which may be adjusted among a gravity feed and horizontal position as desired.

BRIEF DESCRIPTION OF THE INVENTION

The present invention consists of a master assembly having a pair of vertical bars intended to be mounted on horizontally-extending hanging bar units which engage with existing shelving or gondola structures through an interface utilizing the slots of conventional gondola standards which are used to support existing shelving. Each of the hanging bar units includes a hanging bar which is constructed to mate with spaced hanger brackets. The hanger brackets are mountable upon the vertical standards of the gondola structure and thus support the hanging bar from the gondola standards. The hanger brackets are slidable along the length of the hanging bars, which allow a hanging bar to be utilized in connection with gondola standards of varying spacing.

The hanging bars are typically mounted in pairs on the gondola standards, and support the vertical bars, which are provided with spaced pairs of slots which interfit with a horizontal bar member portion of product cradle assemblies. Each cradle assembly includes at least one product support cradle, having a U-shaped wire member which extends outwardly and forwardly from the bottom of the horizontal bar member portion. A pair of spaced wires run from the horizontal legs of the U-shaped wire member to the top of the horizontal bar member. The resulting triangular-sided cylindrical product support cradle provides rigidity with low mass. Cylindrical products may be stacked in an edgewise orientation upon the cradles, the planar tops of the packaging facing forward for viewing by the customer.

The horizontal bar portion of the cradle assembly is provided with mounting clips for engagement with a chosen slot pair in the vertical bars in a manner which allows the angle of the horizontal bar, and thus the projection angle of the cradles, to be varied. The orientation of the cradles may be adjusted either for horizontal positioning of the products thereon or with a forward dip orientation, providing for some measure of gravity feed of the stacked product towards the front of the cradle.

For a more complete understanding of the above and other features and advantages of the present invention, reference should be made to the following detailed description of a preferred, but nonetheless illustrative embodiment of the invention and the accompanying drawings.

Figures 7A, 7B, 8A, 8B, 9:
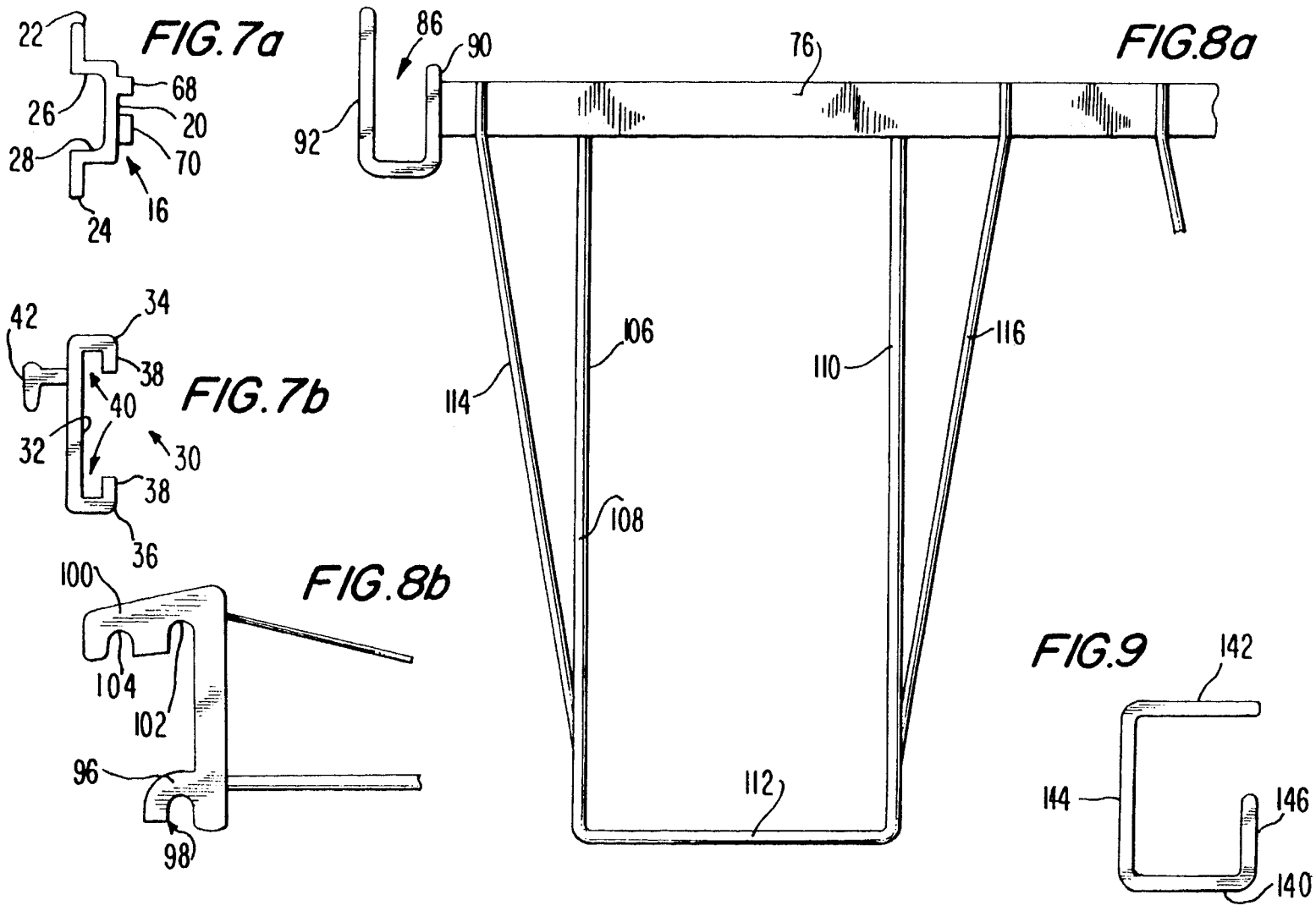

FIGS. *7a* and *7b* are end elevation views of the hanging bar and hanger bracket, respectively,i of the invention;

FIGS. *8a* and *8b* are top plan and end elevation views, respectively, of a portion of a cradle assembly; and FIG. 9 is a top plan view of an alternative form for the vertical bar of the invention.

DETAILED DESCRIPTION OF THE INVENTION

Figure 1:
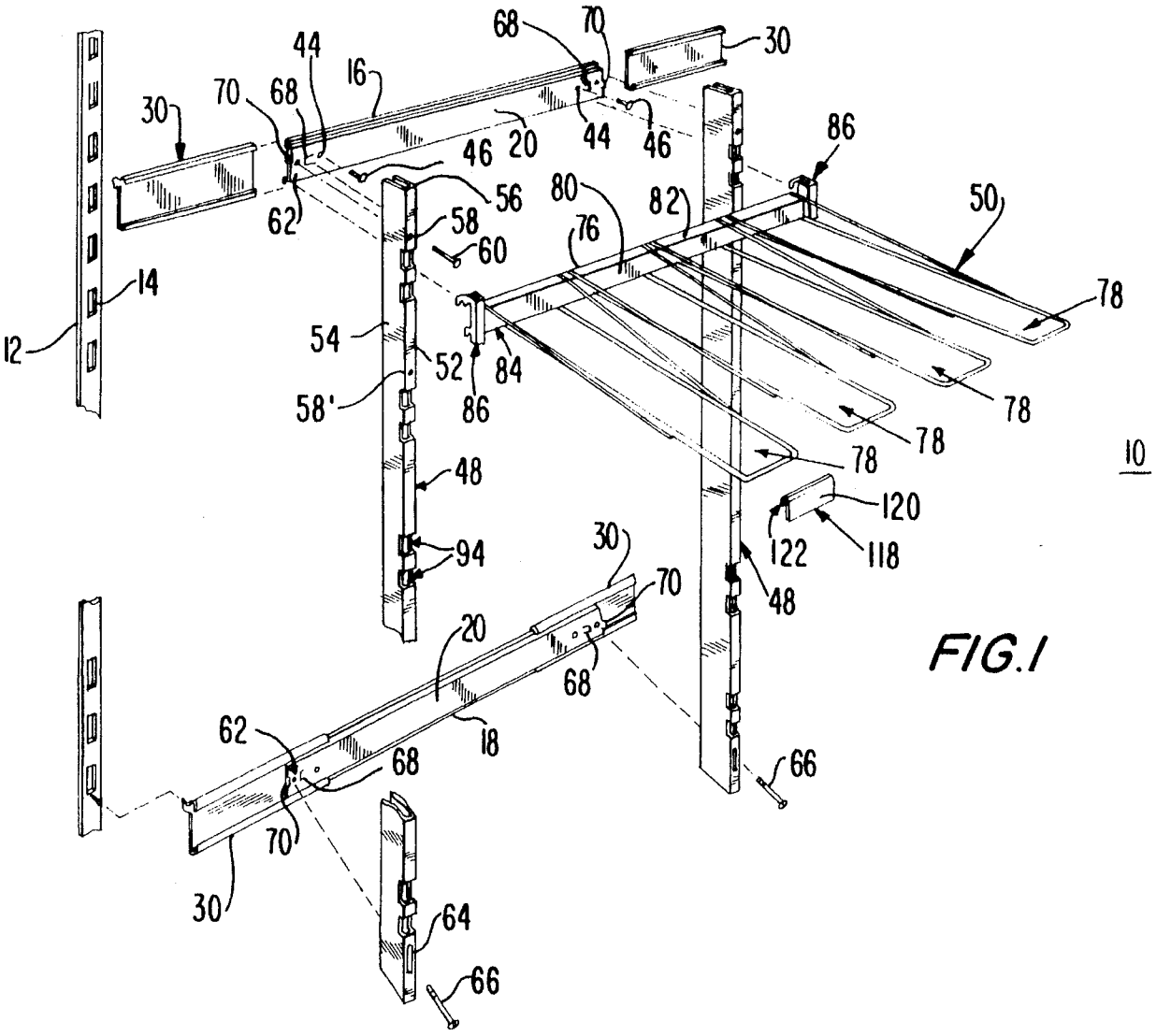
FIG. 1 is a front perspective view, exploded, of the construction of the present invention.
Figure 2:
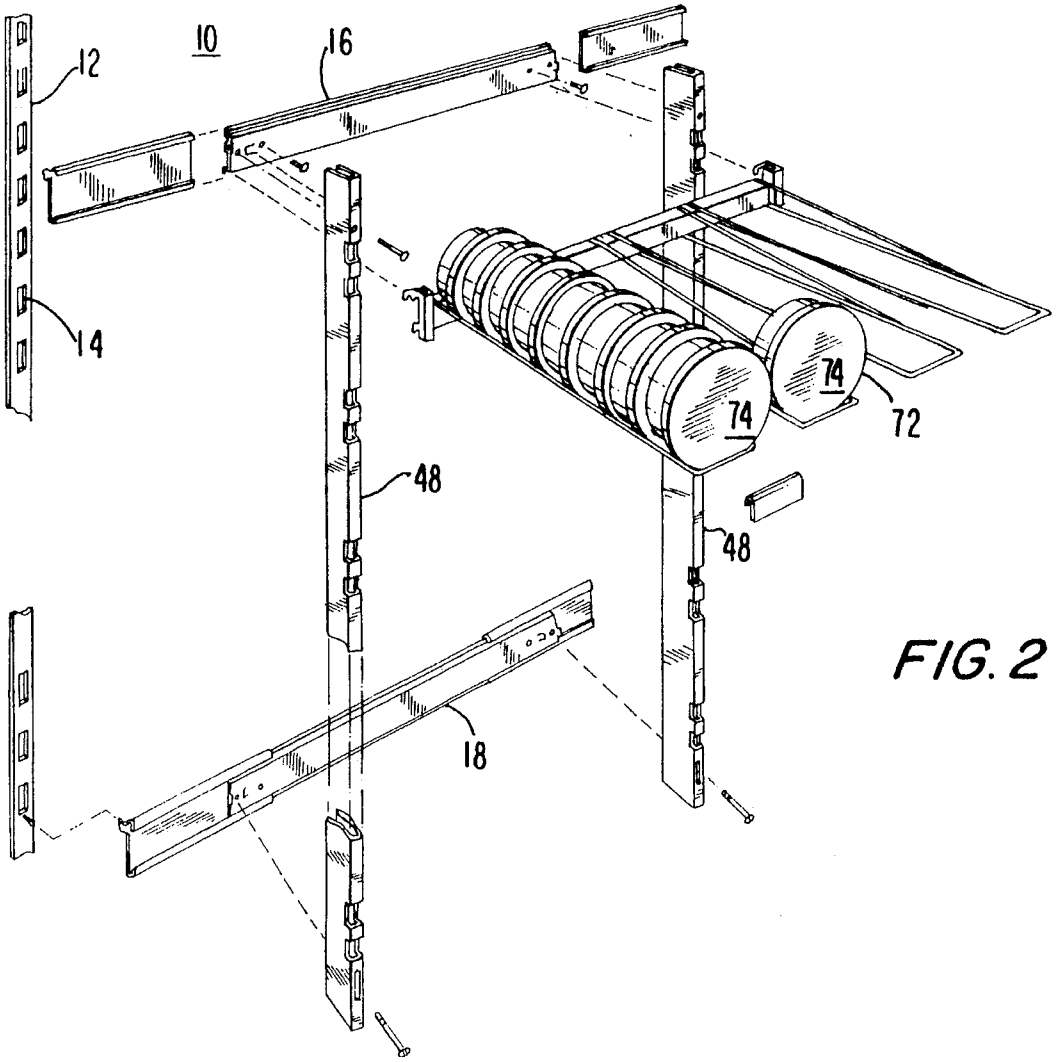
FIG. 2 is a view similar to that of FIG. 1 further depicting product placed in the cradles.

With initial reference to FIGS. 1 and 2, there is presented a cradle assembly product display construction 10 intended to be mounted onto a pair of vertical uprights or standards 12 which form portions of conventional retail gondola constructions and freezer unit shelving supports. Each of the vertical standards 12 is provided with a plurality of vertical slots 14 defined therein. In normal usage, horizontal shelves are secured via hooks upon the slots and are supported in a cantilever fashion from the standards 12.

The present construction 10 comprises a pair of horizontal hanging bars 16, 18 each having a vertical front face 20 (best seen in FIG. *7a*) joined to upper and lower horizontally-extending edge elements 22, 24. The edges 22, 24 are displaced rearwardly of the front face in a common vertical plane by horizontal intermediate wall sections 26, 28, respectively. The opposed ends of each of the hanging bars accept a female bracket member 30, adapted to support the hanging bar and to be mountable upon a vertical standard 12. Accordingly, each of the female bracket members 30 (as best seen in FIG. *7b*) includes a main vertical wall 32 bounded at its top and bottom by forward and inward-facing hook portions 34, 36, extending the length of the bracket. Each of the hooks 34, 36 includes a vertical edge portion 38 spaced forwardly of the main wall 32 to define a groove 40 therebetween, the width of the grooves being dimensioned to accept the upper and lower edge elements 22, 24 of a hanging bar 16. The bracket 30 is further provided with a rearwardly-directed hook 42 dimensioned as known in the art to engage a slot 14 in a standard 12.

As the hooks 34, 36 of the bracket 30 engage the upper and lower edges 22, 24 of a hanging bar 16 in a sliding fit, it is to be appreciated that the hanging bar 16 may be slid and positioned as desired with respect to the brackets 30, the brackets being located along the length of the hanging bar as required to align with the spaced gondola standards 12 and support the hanging bar thereon. The hanging bar may be provided with threaded throughbores 44 proximate the ends thereof, allowing bolts 46 to be threaded therethrough to engage the vertical walls 32 of the aligned brackets 30 to lock the hanging bar 16 in position with respect to the brackets.

The pair of hanging bars 16, 18, when mounted in a vertically-spaced relationship to the vertical standards 12, provide a base structure for the mounting of a pair of vertical bars 48 to which one or more cradle assemblies 50 may be mounted. Each of the vertical bars 48 is preferably of a U-shape cross-section, having a front face portion 52 bounded by rearwardly-directed sidewalls 54, 56. A series of slot pairs 94 is arranged on the front face. Alternatively, the vertical bars may be of the cross-sectional construction depicted in FIG. 9, wherein the vertical bar has front and rear walls 140, 142 joined by main sidewall 144. Stub sidewall 146 projects rearwardly from front wall 140 a portion of the distance to rear wall 142. The rear wall 142 abuts against the front face 20 of the hanging bar.

The vertical bars each are mounted to the hanging bars 16, 18 by use of a first bore 58 located proximate the top end of the vertical bar, the bore 58 accommodating a bolt 60 which engages a mating threaded bore 62 through the front face 20 of the hanging bar. Each vertical bar further includes a vertically-oriented slot 64 on the front wall 52 proximate the lower end of the bar, the slot 64 similarly accommodating a bolt 66 which engages the bore 62 in the front face 20 of the lower oriented hanging bar 18. The slot 64 allows the bolt 66 to be engaged with the hanging bar bore 62 while accommodating variations in the vertical slot-to-slot distance between the slots 14 on the standards 12. Intermediate bores 58' may be provided to allow the top hanging bar 16 to be located downward from the top end of the vertical bars, if desired.

The hanging bars 16, 18 may be further provided with a pair of tabs or projections 68, 70 proximate each end thereof to provide an alignment key for the vertical bars, spacing the vertical bars the appropriate distance from each other on the hanging bar to allow support of the cradle assemblies 50 mounted thereto. Typically, first tab 68 may be formed as a right-angle extension from an end of front face 20, while second tab 70, spaced from first tab 68 the width of the vertical bar 48, is formed as a deformed or partially cut projection formed upon the front face 20.

The cradle assembly 50 which supports cylindrically-packaged products 72 in an orientation in which the package top 74 is oriented vertically, facing forward, as shown in FIG. 2, includes a rear, horizontal bar 76 supporting a plurality of forwardly-extending cradles 78. The horizontal bar 76 is preferably of a U-shape in cross-section, having front vertical face 80 bounded by rearwardly-directed top and bottom walls 82, 84. A pair of mounting brackets 86 (see FIGS. 8A and 8B) are affixed to the ends of the horizontal bar 76, and permit the mounting of the cradle assembly 50 to the vertical bars 48.

In particular, the mounting brackets 86, which may be of a generally U-shaped cross-section, include an inner sidewall 90 which abuts against the end of the horizontal bar 76 and which may be affixed thereto by brazing, welding or other appropriate fastening means. An outwardly-facing sidewall 92 is contoured and dimensioned to engage a pair of the spaced slots 94 on a vertical bar 48, and accordingly includes a bottom hook portion 96 forming a slot edge-engaging notch 98, as well as an upper hook portion 100 having first and second slot edge-engaging notches 102, 104. The notches 102, 104 are each adapted to engage the upper slot of a slot pair 94 in a vertical bar, and allow the angular orientation of the cradle assembly to be adjusted with respect thereto, as will be subsequently explained.

Projecting forwardly from the horizontal bar 76 are one or more cradles 78. Each of the cradles includes a U-shaped wire member 106 having parallel legs 108, 110 spaced a distance defined by the length of front transverse portion 112. The spacing between the legs 108, 110 is chosen to be compatible with the diameter of the product 72 and to allow the product to be supported on its sidewall upon the cradle. The rear ends of the legs 108, 110 are affixed to the bottom wall 84 of the horizontal bar 76. To provide additional support for the products 72 mounted on the cradle, and to provide additional rigidity therefor, a pair of wire side support members 114, 116 extend from the top wall 82 of the horizontal bar 76 to the front portions of the respective legs 108, 110.

As best seen in FIG. 8A, the support wires 114, 116 are affixed to the horizontal bar 76 outboard of the corresponding legs 108, 110, providing a downward and inwardly-sloping, triangular side configuration. The degree of slope and angle are chosen such that the supports 114, 116 engage the sidewalls of stacked products 72 at additional points of contact from that established between the products and legs 108, 110, thus providing additional support therefor while providing rigidity for the cradles.

In a first mounting orientation for the cradle assembly 50, when the notches 98, 102 on the mounting brackets 86 are engaged with a pair of slots 94 on vertical bars 48, the U-shaped support wire 106 is oriented in a horizontal plane, supporting the products 72 in a strictly horizontal orientation. When the bracket notch 98 and second notch 104 are utilized, however, the cradle assembly 50 is provided with a downwardly-slanting orientation, the front ends of the cradles being lower than the rear ends. This provides a slight gravity feed for the aligned products, causing them to migrate towards the front of the cradles, improving customer access and assisting in product alignment for restocking purposes. A hanging tab element 118, having a front face 120 and a mounting hook portion 122, is adapted to be mounted upon the front transverse portion 112 of the wire member 106, allowing UPC and other information to be placed for easy observation by the customer and for product identification for restocking purposes.

Figure 3:
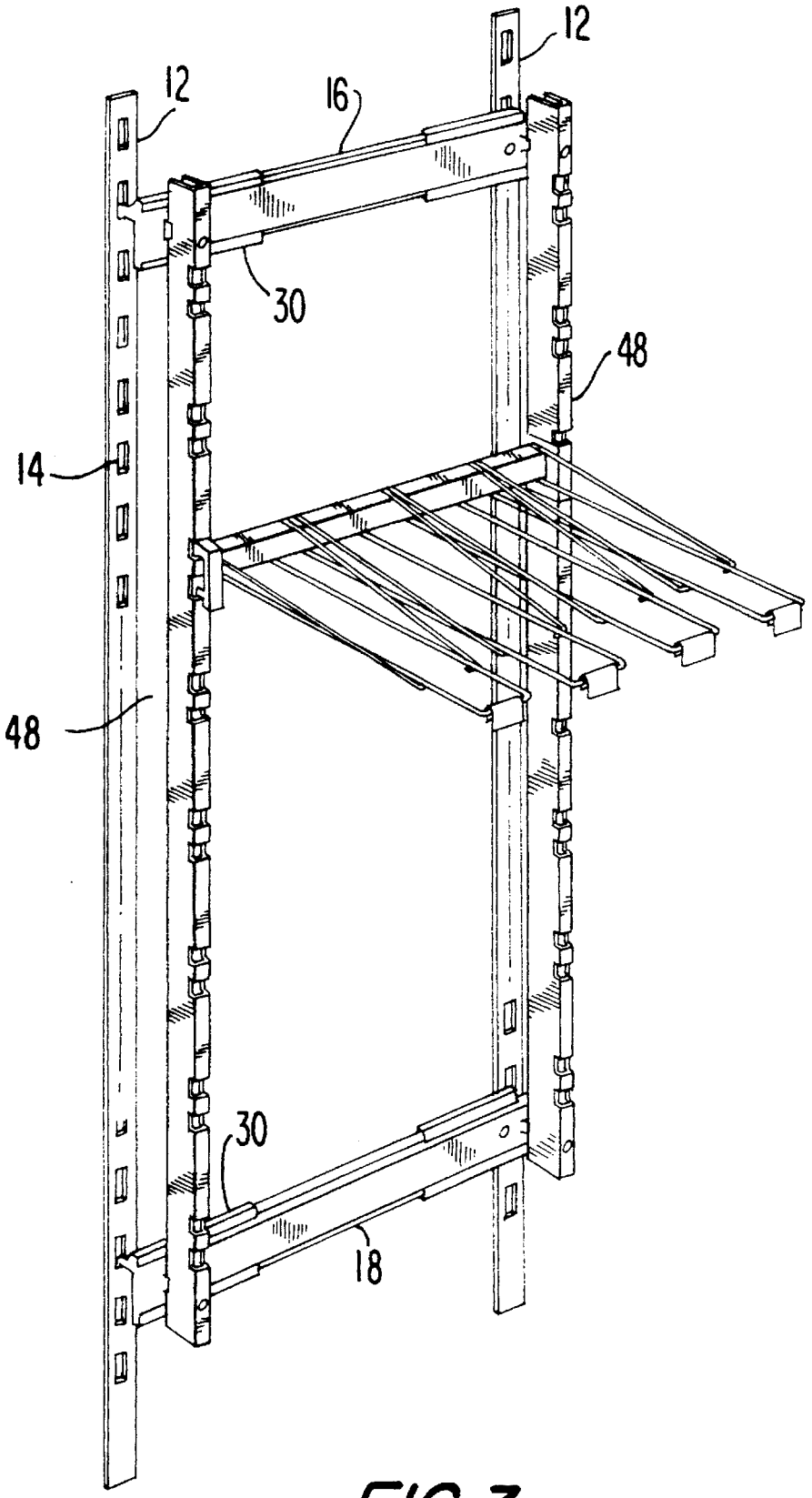
FIG. 3 is a front perspective view of the invention in an assembled position, mounted upon gondola standards having a relatively close spacing.
Figure 4:
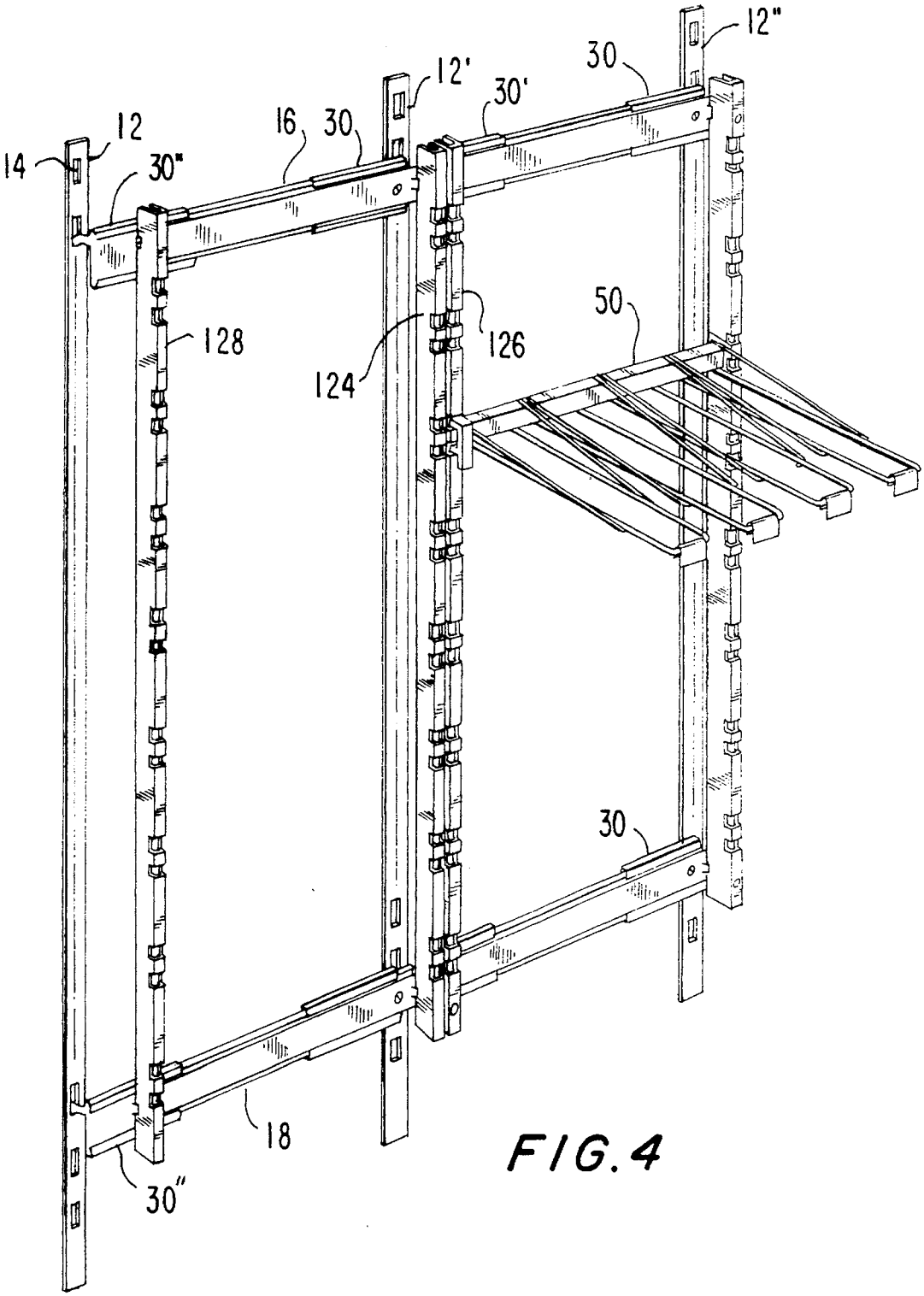
FIG. 4 is a front perspective view of the invention depicting the use of a pair of assemblies aligned across three gondola standards.

A significant advance of the present invention is that it can accommodate a variety of spacings of the gondola standards 12 and allows flexibility of positioning of the vertical bars 48 and thus the cradle assemblies 50 across the width of the gondola or freezer. Thus, as depicted in FIG. 3, gondola standards 12 on a spacing approximately the length of the hanging bars 16, 18, are accommodated by positioning the female bracket members 30 proximate the ends of the hanging bars. As shown in FIG. 4, the display constructions 10 in accordance with the present invention may be aligned in a repeating fashion, spanning a plurality of gondola standards 12, 12' and 12". As shown therein, the adjacent constructions 10 have their respective adjacent vertical bars 124, 126 in a sidewall abutting relationship, allowing mounted cradle assemblies 50 to effectively span the entire width between the outermost gondola standards 12, 12". As the width of the slots 14 in the gondola standards is substantially greater than the thickness of the rearwardly-facing mounting hooks 42 on the female brackets 30, the slots on, for example, upright 12' in FIG. 4 can accommodate the hooks 42 on both bracket 30 and 30', permitting the totality of the display constructions to span a continued expanse defined by a plurality of the standards 12. As may be seen in FIG. 4, the exterior female bracket 30" may extend beyond the outboard edge of the hanging bar 128, accommodating the spacing between the standards 12, 12'.

Figure 5:
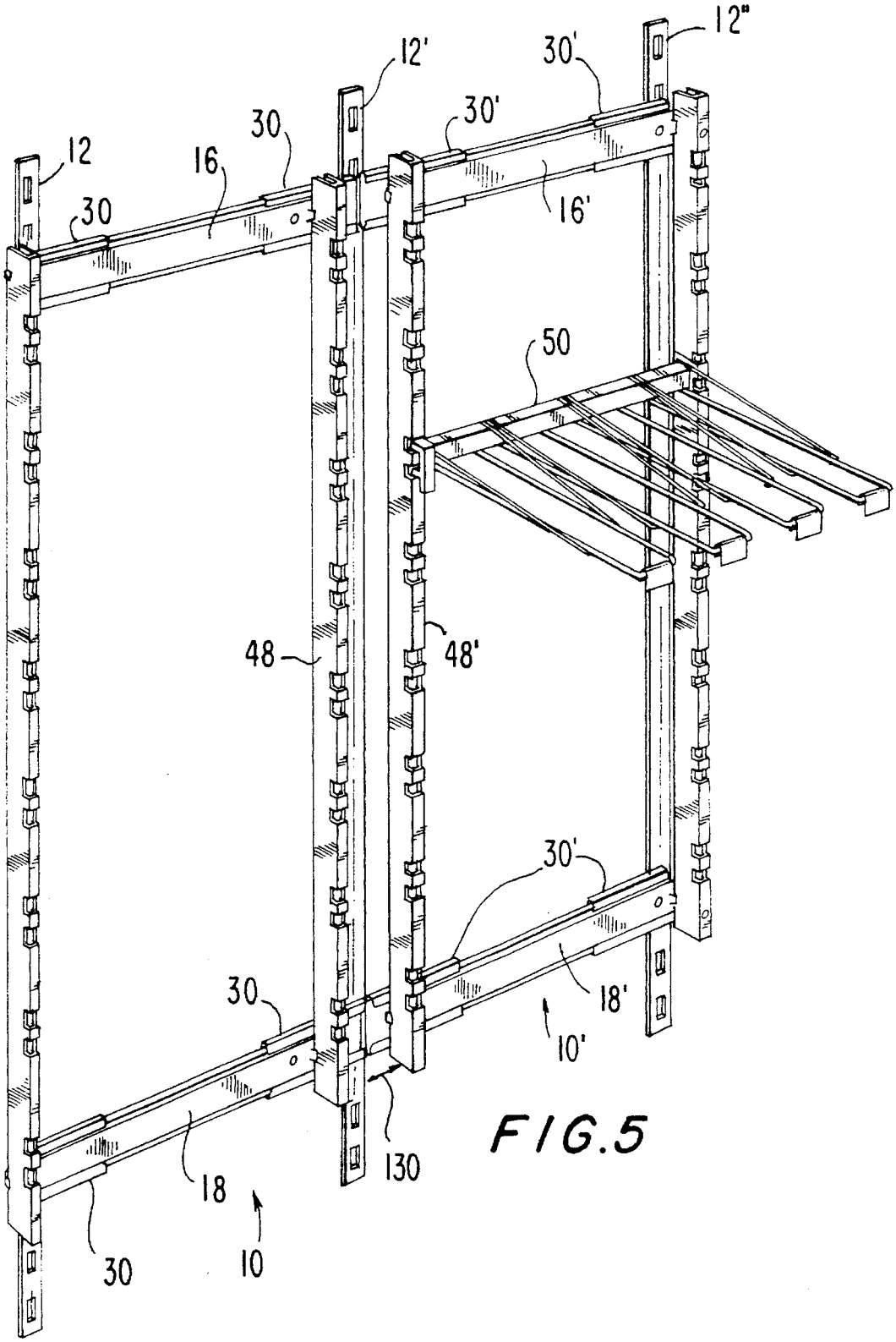
FIG. 5 is a front perspective view of another embodiment of the invention, wherein the vertical bars of the adjacent assemblies are in a spaced orientation.

Because of the variability in spacing between gondola standards 12, the present invention is of substantial utility as it allows the orientation of the display constructions 10 and thus the arrangement of the cradle assemblies 50 to be varied independently of such spacing. As shown in FIG. 5, the display constructions 10 and 10' are arranged with a separation 130 between the adjacent vertical bars 48, 48'. Such a separation can be accommodated, independently of the spacing between the gondola standards 12, 12' and 12" because of the ability of the hanging bars 16, 18 and 16', 18' to be positioned horizontally with respect to the respective female brackets 30 and 30' therefor. The horizontal alignment and orientation of the hanging bars and thus the vertical bars and cradle units 50 mounted thereto can be adjusted with respect to the fixed female brackets 30 and 30'.

Figure 6:
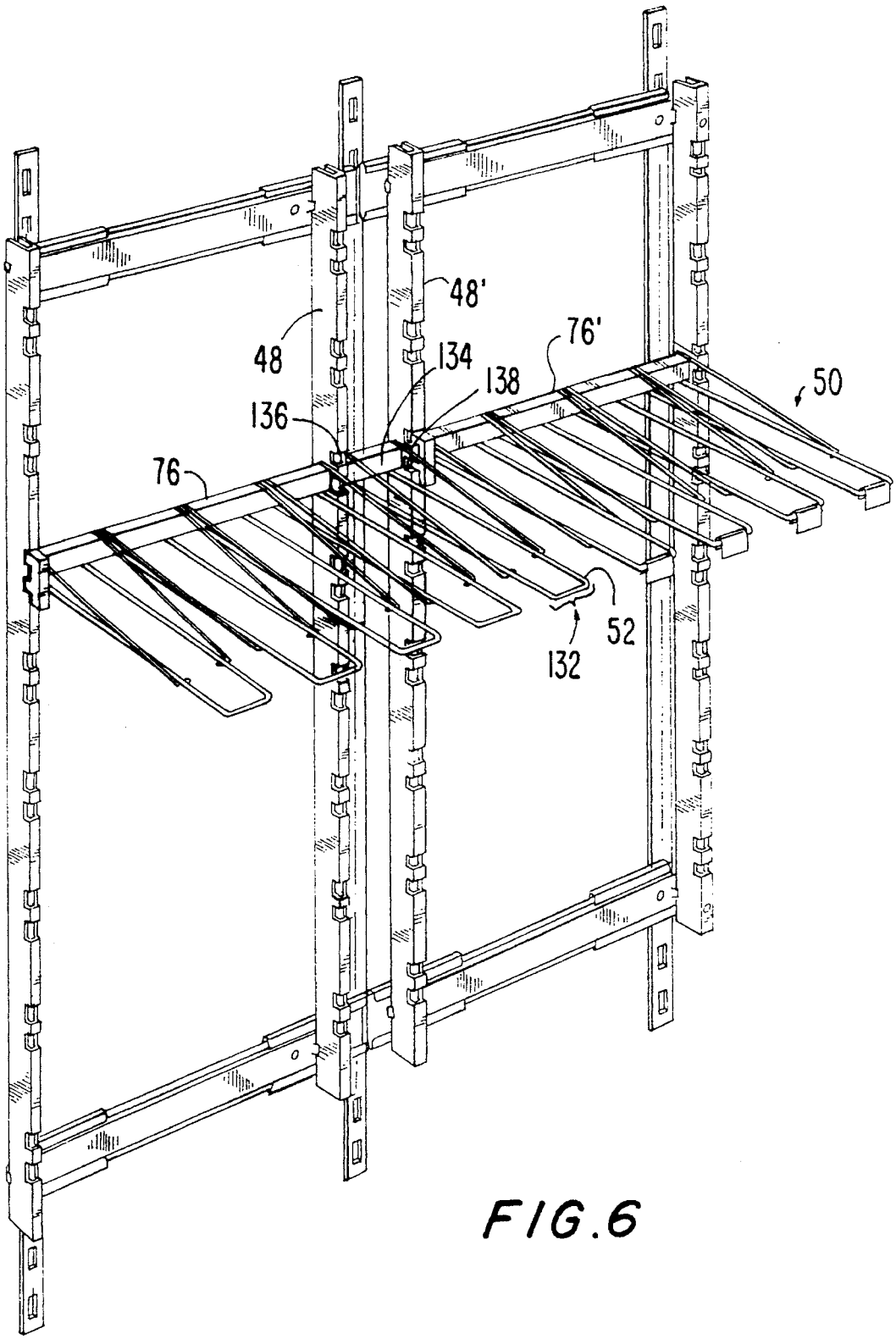
FIG. 6 is a front perspective view of the invention having assemblies of the invention spaced as in FIG. 5, while further incorporating an intermediate horizontal bar to support an additional single cradle.

A horizontally-spaced positioning of the main cradle assemblies 50, resulting from the spaced alignment of the vertical bars 48, 48' in FIG. 5, can be further augmented as shown in FIG. 6 by the use of an intermediate cradle assembly 132 mounted between the spaced adjacent vertical bars 48, 48' of the adjacent shelving constructions 10, 10'. As depicted in FIG. 6, the intermediate cradle assembly 132 consists of an intermediate horizontal bar 134 of reduced length terminating in the mounting brackets 136, 138 in the manner previously described. One or more cradle assemblies 50 may be mounted to the horizontal bar, depending upon the length thereof. As the vertical bars 48 have a spacing between their sidewalls 54, 56 and thus a slot width for the slot pairs 94 chosen to receive two adjacent mounting bracket sidewalls 92 bearing notch 98, and the first and second notches 102, 104, the slot pairs 94 are able to accommodate a pair of abutting mounting brackets. Accordingly, the intermediate horizontal bar 134 may be mounted to the vertical bars 48, 48' along with horizontal bars 76, 76' of the main constructions 10, providing additional mounting area between the main constructions.

As may be appreciated, the present invention allows for efficient use of storage and display space in retail environments for products packaged in cylindrical packaging, a package shape which traditionally has been difficult to display and present in an effective manner. It should be understood, of course, that the specific forms of the invention herein illustrated and described are intended to be representative only, as changes may be made therein without departing from the teachings of the disclosure.

We claim:

1. An improved bracket construction for the storage and display of cylindrically and dish-packaged products, comprising:

a pair of horizontal hanging bars adapted to mount to vertical gondola standards;

a plurality of vertical uprights affixed to said hanging bars; and at least one cradle assembly mounted to said vertical uprights, said cradle assembly adapted and dimensioned to support cylindrically and dish-packaged products thereon in an edgewise orientation, said cradle assembly comprising a horizontal bar mountable to said vertical uprights and at least one product cradle extending forwardly from the horizontal bar comprising a U-shaped element having a front transverse portion and a pair of legs mounted to a bottom of said horizontal bar and a support wire extending from each of said legs to a top of said horizontal bar outwardly of the mount of the respective leg to said horizontal bar.

2. The bracket construction of claim 1, wherein said horizontal bar includes means for mounting said cradle assembly to said vertical uprights in first and second orientations for varying the angle of forward projection of said at least one product cradle.

3. The bracket construction of claim 1, further comprising a hanging tab mounted to said transverse portion.

4. The bracket construction of claim 1, wherein each of said horizontal hanging bar units comprise a hanging bar adapted to accept said vertical upright and a pair of bracket members adapted to mount to said vertical gondola standards.

5. The bracket construction of claim 4, wherein said hanging bar is mateable with said bracket members, said bracket members being independently positionable along said hanging bar unit.

6. The bracket construction of claim 5, wherein said hanging bar comprises a pair of edge elements in a common plane and said bracket members each comprise a pair of hook portions adapted to engage said edge members for a sliding fit therebetween.

7. The bracket construction of claim 6, wherein said hanging bar comprises alignment means for positioning said vertical uprights thereon.

8. The bracket construction of claim 7, wherein said alignment means comprise at least one pair of projections on a front face of said hanging bar spaced to accept one of said vertical uprights therebetween.

9. The bracket construction of claim 2, wherein said mounting means for said cradle assembly comprise pairs of vertically oriented slots on a front face of each of said vertical uprights and mating hook assemblies extending rearwardly from said cradle horizontal bar.

10. The bracket construction of claim 9, wherein each of said hook assemblies comprises a first hook having a notch adapted to engage a first lower slot of a slot pair of said vertical upright and a second hook having first and second notches adapted to alternatively engage a second upper slot of said slot pair.

* * * * *